United States Patent [19]

Clark et al.

[11] Patent Number: 4,879,022

[45] Date of Patent: Nov. 7, 1989

[54] ORE FLOTATION PROCESS AND USE OF MIXED HYDROCARBYL DITHIOPHOSPHORIC ACIDS AND SALTS THEREOF

[75] Inventors: Alan C. Clark, Mentor; Edward P. Richards, Chagrin Falls, both of Ohio; Douglas R. Shaw, Lakewood, Colo.

[73] Assignee: The Lubrizol Corporation, Wickliffe, Ohio

[21] Appl. No.: 300,694

[22] Filed: Jan. 19, 1989

Related U.S. Application Data

[63] Continuation of Ser. No. 72,809, Jul. 14, 1987, abandoned.

[51] Int. Cl.[4] ..... B03D 1/02

[52] U.S. Cl. ..... 209/166; 252/61; 241/24; 423/26; 209/167

[58] Field of Search ..... 209/166, 167; 252/61; 75/2; 423/26; 241/24

[56] References Cited

U.S. PATENT DOCUMENTS

| | | | |
|---|---|---|---|
| 1,377,189 | 5/1921 | Dosenbach | 209/167 |
| 1,486,297 | 3/1924 | Pallanch | 209/167 |
| 1,593,232 | 7/1926 | Whitworth | 209/166 |
| 1,678,259 | 7/1928 | Martin | 209/167 |
| 1,873,115 | 8/1932 | Derby | 209/166 |
| 2,012,830 | 8/1935 | Ralston | 209/167 |
| 2,038,400 | 4/1936 | Whitworth | 209/166 |
| 2,063,629 | 12/1936 | Sulzberg | 209/166 |
| 2,206,284 | 7/1940 | Jayne, Jr. | 252/9 |
| 2,849,475 | 8/1958 | Capenter | 252/61 |
| 2,919,025 | 12/1959 | Booth et al. | 209/166 |
| 3,086,653 | 4/1963 | Booth | 209/166 |

(List continued on next page.)

FOREIGN PATENT DOCUMENTS 499430 4/1979 Australia .

OTHER PUBLICATIONS

Froth Flotation-50th Anniversary vol. Fuerstenaw (Editor) Published by AIMM & PE Inc. 1962, pp. 420-422.

(List continued on next page.)

*Primary Examiner*—Kenneth M. Schor
*Assistant Examiner*—Thomas M. Lithgow
*Attorney, Agent, or Firm*—Robert A. Franks; Frederick D. Hunter; Forrest L. Collins

[57] ABSTRACT

The present invention relates to an improved process for beneficiating an ore containing sulfide materials with selective rejection of pyrite, pyrrhotite and other metals and gangue. In particular, the process is useful for beneficiating ores and recovering copper from said ores. In one embodiment the process comprises the steps of (A) grinding the ore to an appropriate size range;

(B) preparing a slurry comprising (B-1) said ground ore;

(B-2) at least one collector which is a water-dispersible or soluble dihydrocarbyldithiodiphosphoric acid or salt having the formula (I)

wherein $R^1$ and $R^2$ are different hydrocarbyl groups containing up to about 12 carbon atoms, n is an integer equal to the valence of X and $X^{n+}$ is a dissociating cation; and (B-3) water;

(C) conditioning the slurry with $SO_2$ under aeration at a pH of about 5.5 to about 7.5;

(D) subjecting the conditioned slurry to froth flotation to produce a froth containing a metal rougher concentrate;

(E) collecting said froth; and (F) recovering the metal rougher concentrate containing the desired metal values.

34 Claims, 1 Drawing Sheet

U.S. PATENT DOCUMENTS

| | | | |
|---|---|---|---|
| 3,220,551 | 11/1965 | Moyer | 209/167 |
| 3,570,772 | 3/1971 | Booth et al. | 241/24 |
| 4,040,950 | 8/1977 | Zipperian | 209/166 |
| 4,283,017 | 8/1981 | Coale et al. | 241/24 |
| 4,460,459 | 7/1984 | Shaw et al. | 209/9 |
| 4,530,758 | 7/1985 | Tibbals | 209/166 |
| 4,684,459 | 8/1987 | Klimpel | 209/166 |
| 4,699,712 | 10/1987 | Unger | 209/166 |

OTHER PUBLICATIONS

"Organic Chemistry"by Morrison and Boyd, 3rd Edition ©1973 Allyn and Bacon Inc. p. 338.

The Separation by Flotation of Copper-Lead-Zinc Sulphides by B. A. Willis. Minning Magazine 150, Jan. 1984.

Ullmanns Encyklopädie Der Technischen Chemie, Weinheim 1979.

The Broken Hill Concentrator of Black Mountain Mineral Development Co. (Pty.) Ltd., South Africa, Paper Presented at the Complex Sufide Ores Conference, The Institute of Mining and Metallurgy, Rome, Italy, Oct. 5-8, 1980.

Metallurgical Development at Woodlawn Mines, Australia, Paper Presented at the Complex Sulfide Ores Conference, The Institute of Mining and Metallurgy, Rome, Italy, Oct. 5-8, 1980.

ORE FLOTATION PROCESS AND USE OF MIXED HYDROCARBYL DITHIOPHOSPHORIC ACIDS AND SALTS THEREOF

This is a continuation of co-pending application Ser. No. 072,809, filed on July 14, 1987, now abandoned.

TECHNICAL FIELD OF THE INVENTION

This invention relates to froth flotation processes for the recovery of metal values from metal sulfide ores. More particularly, it relates to the use of improved collectors for beneficiating mineral values comprising hydrocarbyl dithiophosphoric acids or salts derived from a mixture of alcohols.

BACKGROUND OF THE INVENTION

Froth flotation is one of the most widely used process for beneficiating ores containing valuable minerals. It is especially useful for separating finely ground valuable minerals from their associated gangue or for separating valuable minerals from one another. The process is based on the affinity of suitably prepared mineral surfaces for air bubbles. In froth flotation, a froth or a foam is formed by introducing air into an agitated pulp of the finely ground ore in water containing a frothing or foaming agent. A main advantage of separation by froth flotation is that it is a relatively efficient operation at a substantially lower cost than many other processes.

It is common practice to include in the flotation process, one or more reagents called collectors or promoters that impart selective hydrophobicity to the valuable mineral that is to be separated from the other minerals. It has been suggested that the flotation separation of one mineral species from another depends upon the relative wettability of mineral surfaces by water. Many types of compounds have been suggested and used as collectors in froth flotation processes for the recovery of metal values. Examples of such types of collectors include the xanthates, xanthate esters, dithiophosphates, dithiocarbamates, trithiocarbonates, mercaptans and thionocarbonates. Xanthates and dithiophosphates have been employed extensively as sulfide collectors in froth flotation of base metal sulfide ores. One of the problems associated with these conventional sulfide collectors is that at pH's below 11.0, poor rejection of pyrite or pyrrhotite is obtained. In addition, as the pH decreases, the collecting power of the sulfide collectors also decreases rendering them unsuitable for flotation in mildly alkaline, neutral or acid environments. Suggestions have been made in the art for modifications of the xanthates and dithiocarbamates for improving their utility as sulfide collectors in a variety of froth flotation processes.

Dialkyldithiophosphoric acids and salts thereof such as the sodium, potassium, calcium or ammonium salts have been utilized as promoters or collectors in the beneficiation of mineral-bearing ores by flotation for many years. Early references to these compounds and their use as flotation promoters may be found in, for example, U.S. Pat. Nos. 1,593,232 and 2,038,400. Ammonium salt solutions of the dithiophosphoric acids are disclosed as useful in U.S. Pat. No. 2,206,284, and hydrollyzed compounds are disclosed as useful in U.S. Pat. No. 2,919,025.

The diesters of dithiophosphoric acids utilized as flotation promoters and collectors for sulfide and precious metal ores are obtained by reacting an alcohol with phosphorus and sulfur generally as $P_2S_5$. The acid obtained in this manner can then be neutralized to form a salt which is stable yet soluble in water.

U.S. Pat. No. 3,086,653 describes aqueous solutions of alkali and alkaline earth metal salts of phosphoorganic compounds useful as promoters or collectors in froth flotation of sulfide ores. The phosphoorganic compounds are neutralized $P_2S_5$ alkanol reaction products. Although single alcohols are normally used in the reaction, the patentees disclose that mixtures of isomers of the same alcohol, and mixtures of different alcohols may be utilized as starting materials in the preparation of the phosphorus compound, and the resulting acidic products can be readily neutralized to form stable solutions which are useful as flotation agents.

U.S. Pat. No. 3,570,772 describes the use of di(4,5-carbon branched primary alkyl) dithiophosphate promoters for the flotation of copper middlings. The 4 and 5 carbon alcohols used as starting materials may be either single alcohols or mixtures of alcohols.

Procedures for the selective flotation of copper from copper sulfide ores wherein a slurry of ore and water is prepared and sulfurous acid is added to the slurry to condition the slurry prior to the froth flotation step have been discussed in, for example, U.S. Pat. Nos. 4,283,017 and 4,460,459. Generally, the pulp is conditioned with sulfur dioxide as sulfurous acid under intense aeration. This conditioning of the slurry enhances the promotion and flotation rate of copper in the subsequent flotation step. Generally, the amount of sulfur dioxide added ranges from about 1 to 5 pounds of sulfur dioxide per ton of ore. In U.S. Pat. No. 4,283,017, the desirable pH of the conditioned slurry is reported to be between about 5 and about 6.5, and preferably between 5.5 and 6.0. In U.S. Pat. No. 4,460,459, the pH of the conditioned slurry is reported as being from about 6.5 to 6.8.

SUMMARY OF THE INVENTION

The present invention relates to an improved process for beneficiating an ore containing sulfide materials with selective rejection of pyrite, pyrrhotite and other minerals and gangue. In particular, the process is useful for beneficiating ores and recovering metals such as copper, lead, zinc, etc., from said ores. In one embodiment the process comprises the steps of (A) grinding the ore to an appropriate size range;

(B) preparing a slurry comprising (B-1) said ground ore;

(B-2) at least one collector which is a water-dispersible or soluble dihydrocarbyldithiodiphosphoric acid or salt having the formula

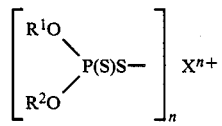

(I)

wherein $R^1$ and $R^2$ are different hydrocarbyl groups containing up to about 18 carbon atoms, n is an integer equal to the valence of X and $X^{n+}$ is a dissociating cation;

(B-3) water; and optionally (B-4) a water-soluble inorganic base;

(C) conditioning the slurry with $SO_2$ under aeration at a pH of about 5.5 to about 7.5;

(D) subjecting the conditioned slurry to froth flotation to produce a froth containing a metal rougher concentrate;

(E) collecting said froth; and (F) recovering the metal rougher concentrate containing the desired metal values.

BRIEF DESCRIPTION OF THE DRAWING

The sole FIGURE is a block-diagram representation of a flow sheet of the flotation process according to the present invention.

DETAILED DESCRIPTION OF THE INVENTION

Figure 1:
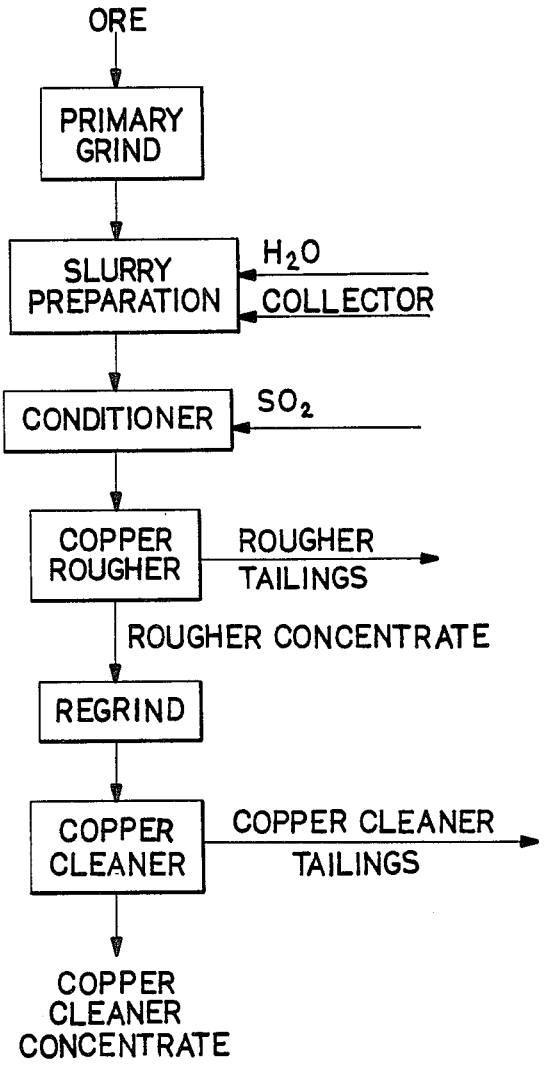

The froth flotation process of the present invention is useful to beneficiate sulfide mineral and metal values from sulfide ores including, for example, copper, lead, zinc, nickel, and cobalt. Lead can be beneficiated from minerals such as galena (PbS) and zinc can be beneficiated from minerals such as sphalerite (ZnS), both of which can be found in Central Missouri deposits. Cobalt-nickel sulfide ores such as siegenite or linnalite also available from Mississippi Valley deposits can be beneficiated in accordance with this invention. The copper sulfide minerals which can be beneficiated in accordance with this invention are primarily chalcopyrites ($CuFeS_2$). The invention is useful particularly in beneficiating the complex copper sulfide minerals such as obtained from the Cerro, Colorado mines, central and eastern Canada (Kidd Creek mine, New Brunswick mines, etc.) Australia, Spain and South Africa. The complex sulfide ores contain large amounts of pyrite, (and other iron sulfides generally are relatively to beneficiate.

In the following description of the invention, however, comments primarily will be directed toward the beneficiation and recovery of copper, and it is intended that such discussion shall also apply to the other above-identified minerals. The process of the present invention has been found to be particularly useful in beneficiating complex copper sulfide ores such as the Rio Tinto Minera Cerro Colorado copper-pyrite ores.

The ores which are treated in accordance with the process of the present invention must be reduced in size to provide ore particles of flotation size. As is apparent to those skilled in the art, the particle size to which an ore must be reduced in order to liberate mineral values from associated gangue and non-value metals will vary from ore to ore and depends upon several factors, such as, for example, the geometry of the mineral deposits within the ore, e.g., striations, agglomerations, etc. Generally, suitable particle sizes are minus 10 mesh (Tyler) with 50% or more passing 200 mesh. The size reduction of the ores may be performed in accordance with any method known to those skilled in the art. For example, the ore can be crushed to about minus 10 mesh size followed by wet grinding in a steel ball mill to specified mesh size ranges. Alternatively, pebble milling may be used. The procedure used in reducing the particle size of the ore is not critical to the method of this invention so long as particles of effective flotation size are provided.

Water is be added to the grinding mill to facilitate the size reduction and to provide an aqueous pulp or slurry. The amount of water contained in the grinding mill be varied depending on the desired solid content of the pulp or slurry obtained from the grinding mill. Conditioning agents as known in the art may be added to the grinding mill prior to or during the grinding of crude ore. Optionally, water-soluble inorganic bases and/or collectors also can be included in the grinding mill.

In accordance with the process of the present invention, an aqueous slurry is prepared containing the ground ore and (B-2) at least one collector which is a water-dispersible or soluble dihydrocarbyl dithiophosphoric acid or salt having the formula

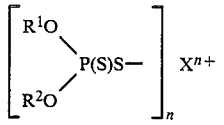

wherein $R^1$ and $R^2$ are different hydrocarbyl groups containing up to about 18 carbon atoms, n is an integer equal to the valence of X, and $X^{n+}$ is a dissociating cation. The amount of collector (B-2) included in the slurry will depend upon a number of factors including the nature of the ore, the size of the ore, etc. In general, amounts of from about 0.01 to about 0.2 pound of collector (B-2) may be used in the process of this invention per ton of ore.

As used in this specification and the appended claims, the term "ton" refers to a short ton, e.g., 2000 pounds. The terms "hydrocarbyl" or "hydrocarbon-based" denote a group having a carbon atom directly attached to the remainder of the molecule and having predominantly hydrocarbon character within the context of this invention. Such groups include the following:.

(1) Hydrocarbon groups; that is, aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group). Such groups are known to those skilled in the art. Examples include methyl, ethyl, octyl, decyl, octadecyl, cyclohexyl, phenyl, etc.

(2) Substituted hydrocarbon groups; that is, groups containing non-hydrocarbon substituents which, in the context of this invention, do not alter the predominantly hydrocarbon character of the group. Those skilled in the art will be aware of suitable substituents. Examples include halo, hydroxy, nitro, cyano, alkoxy, acyl, etc.

(3) Hetero groups; that is, groups which, while predominantly hydrocarbon in character within the context of this invention, contain atoms other than carbon in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbyl group.

The hydrocarbyl groups $R^1$ and $R^2$ may be different aliphatic, different aromatic, and/or mixtures of aliphatic and aromatic groups containing up to about 18 carbon atoms. More generally, the alkyl groups will contain from about 2 to about 12 carbon atoms, and the aryl groups will contain from about 6 to about 18 carbon atoms. Thus, in one embodiment, $R^1$ and $R^2$ are different aliphatic groups; in a second embodiment, $R^1$ and $R^2$ are different aromatic groups, and in a third embodiment, $R^1$ may be an aliphatic group and $R^2$ an aromatic group.

As noted, $X^{n+}$ may be any dissociating cation, and in one embodiment X is hydrogen, an ammonium group, an alkali metal or an alkaline earth metal. Water-soluble collectors generally are preferred, and thus, X normally is an ammonium group, an alkali metal or certain Group II metals. The alkali metals, sodium and potassium are particularly preferred.

The dihydrocarbyldithiophosphoric acids and salts represented by Formula I are known compounds and may be prepared by the reaction of a mixture of hydroxy-containing organic compounds such as alcohols and phenols with a phosphorus sulfide such as $P_2S_5$. The dithiophosphoric acids generally are prepared by reacting from about 3 to 5 moles, more generally 4 moles of the hydroxy-containing organic compound (alcohol or phenol) with one mole of phosphorus pentasulfide in an inert atmosphere at temperatures from about 50° C. to about 200° C. with the evolution of hydrogen sulfide. The reaction normally is completed in about 1 to 3 hours. The salts of the phosphorodithioic acids can be prepared also by techniques well known to those in the art including the reaction of the dithiophosphoric acid with ammonia, and various derivatives of alkali and Group II metals such as the oxides, hydroxides, etc. The formation of the salt typically is carried out in the presence of a diluent (e.g., alcohol, water, or diluent oil).

The composition of the phosphorodithioic acid obtained by the reaction of a mixture of hydroxy-containing organic compounds with phosphorus pentasulfide is actually a statistical mixture of phosphorodithioic acids wherein, with reference to Formula I derived from a mixture of two hydroxy compounds, $R^1OH$ and $R^2OH$, $R^1$ and $R^2$ in one of the acids are different hydrocarbyl groups derived from the different alcohols, $R^1$ and $R^2$ in a second phosphorodithioic acid are identical and derived from one of the alcohols, and $R^1$ and $R^2$ in a third phosphorodithioic acid are identical but derived from the second alcohol of the alcohol mixture. In the present invention it is preferred to select the amount of the two or more hydroxy compounds reacted with $P_2P_5$ to result in a mixture in which the predominating dithiophosphoric acid is the acid (or acids) containing two different hydrocarbyl groups. In the following Examples 1–4, the product is a statistical mixture of at least three phosphorodithioic acids, and the predominating acid in each example contains different $R^1$ and $R^2$ groups.

Monohydroxy organic compounds useful in the preparation of the dihydrocarbylphosphorodithioic acids and salts useful in the present invention include alcohols, phenol and alkyl phenols including their substituted derivatives, e.g., nitro-, halo-, alkoxy-, hydroxy-, carboxy-, etc. Suitable alcohols include, for example, ethanol, n-propanol, isopropanol, n-butanol, 2-butanol, 2-methyl-propanol, n-pentanol, 2-pentanol, 3-pentanol, 2-methylbutanol, 3-methyl-2-pentanol, n-hexanol, 2-hexanol, 3-hexanol, 4-methyl-2-pentanol, 2-methyl-3-pentanol, cyclohexanol, chlorocylohexanol, methylcyclohexanol, heptanol, 2-ethylhexanol, n-octanol, nononanol, dodecanol, etc. The phenols suitable for the purposes of the invention include alkyl phenols and substituted phenols such as phenol, chlorophenol, bromophenol, nitrophenol, methoxyphenol, cresol, propylphenol, heptylphenol, octylphenol, decyl phenol, dodecyl phenol, and commercially available mixtures of phenols. The aliphatic alcohols containing from about 4 to 6 carbon atoms are particularly useful in preparing the dithiophosphoric acids and salts, etc.

Typical mixtures of alcohols and phenols which can be used in the preparation of dithiophosphoric acids and salts of Formula I include: isobutyl and n-amyl alcohols; sec-butyl and n-amyl alcohols; propyl and n-hexyl alcohols; isobutyl alcohol, n-amyl alcohol and 2-methyl-1-butanol; phenol and n-amyl alcohol; phenol and cresol, etc.

The phosphorodithioic acids and salts useful as collectors in the process of the present invention are exemplified by the acids and salts prepared in the following examples. Unless otherwise indicated in the following examples or elsewhere in the specification and claims, all parts and percentages are by weight and all temperatures are in degrees centigrade.

EXAMPLE 1

To 804 parts of a mixture of 6.5 moles of isobutyl alcohol and 3.5 moles of mixed primary amyl alcohols (65%w n-amyl and 35%w 2-methyl-1-butanol) is prepared, and there are added 555 parts (2.5 moles) of phosphorus pentasulfide while maintaining the reaction temperature between about 104°–107° C. After all of the phosphorus pentasulfide is added, the mixture is heated for an additional period to insure completion of the reaction and filtered. The filtrate is the desired phosphorodithioic acid which contains about 11.2% phosphorus and 22.0% sulfur.

EXAMPLE 2

The general procedure of Example 1 is repeated except that the alcohol mixture reacted with phosphorus pentasulfide comprises 40 mole percent of isopropyl alcohol and 60 mole percent of 4-methyl-s-amyl alcohol. The phosphorodithioic acid prepared in this manner contains about 10.6% of phosphorus.

EXAMPLE 3

A mixture of 246 parts (2 equivalents) of Cresylic Acid 33 (a mixture of mono-, di- and tri-substituted alkyl phenols containing from 1 to 3 carbon atoms in the alkyl group commercially available from Merichem Company of Houston, Tex.), 260 parts (2 equivalents) of isooctyl alcohol and 14 parts of caprolactam is heated to 55° C. under a nitrogen atmosphere. Phosphorus pentasulfide (222 parts, 2 equivalents) is added in portions over a period of one hour while maintaining the temperature at about 78° C. The mixture is maintained at this temperature for an additional hour until completion of the phosphorus pentasulfide addition and then cooled to room temperature. The reaction mixture is filtered through a filter aid, and the filtrate is the desired phosphorodithioic acid.

EXAMPLE 4

A mixture of 2945 parts (24 equivalents) of Cresylic Acid 57 (Merichem) and 1152 parts (6 equivalents) of heptylphenol is heated to 105° C. under a nitrogen atmosphere whereupon 1665 parts (15 equivalents) of phosphorus pentasulfide are added in portions over a period of 3 hours while maintaining the temperature of the mixture between about 115°–120° C. The mixture is maintained at this temperature for an additional 1.5 hours upon completion of addition of the phosphorus pentasulfide and then cooled to room temperature. The reaction mixture is filtered through a filter aid, and the filtrate is the desired phosphorodithioic acid.

EXAMPLE 5

A mixture of 400 parts of 50% aqueous sodium hydroxide (5.7 equivalents) and 1137 parts of water is prepared, and a mixture of 90 parts (1.1 equivalents) of a 60/40 mixture of isobutyl alcohol/primary amyl alcohol mixture and 1424 parts (5 equivalents) of the phosphorodithioic acid of Example 1 is added dropwise while maintaining the reaction temperature at about 40°-45° C. over a period of 4 hours. After the addition is completed, the mixture is stirred for 45 minutes, and an additional 56 parts of the 50% aqueous sodium hydroxide solution are added with stirring. The color of the mixture changes from dark green to yellow, and 287 parts of water is added with stirring. The mixture, after cooling, is filtered through a filter aid, and the filtrate is the desired sodium salt containing 10.5% sulfur (theory, 9.43) and 3.52% sodium (theory, 3.86).

EXAMPLE 6

A mixture of 176 parts of a 50% aqueous solution of sodium hydroxide, 189 parts of the alcohol mixture of Example 1 and 40 parts of water is prepared, and 581.4 parts of the phosphorodithioic acid of Example 1 are added over a period of 2 hours while maintaining the temperature of the mixture at less than 50° C. After the addition is completed, the mixture is maintained at 50°-55° C. for 2 hours and filtered. The filtrate is the desired product containing 12.95% sulfur (theory, 12.98).

EXAMPLE 7

A mixture of 448 parts of zinc oxide (11 equivalents) and 467 parts of the alcohol mixture of Example 1 is prepared, and 3030 parts (10.5 equivalents) of the phosphorodithioic acid of Example 1 are added at a rate to maintain the reaction temperature at about 45°-50° C. The addition is completed in 3.5 hours whereupon the temperature of the mixture is raised to 75° C. for 45 minutes. After cooling to about 50° C., an additional 61 parts of zinc oxide (1.5 equivalents) are added, and this mixture is heated to 75° C. for 2.5 hours. After cooling to ambient temperature, the mixture is stripped to 124° C. at 12 mm. pressure. The residue is filtered twice through a filter aid, and the filtrate is the desired zinc salt containing 22.2% sulfur (theory, 22.0), 10.4% phosphorus (theory, 10.6) and 10.6% zinc (theory, 11.1).

EXAMPLE 8

A mixture of 160 parts of a 50% aqueous solution of sodium hydroxide, 40 parts of water and 200 parts of the alcohol mixture of Example 5 is prepared, and 626 parts of the phosphorodithioic acid of Example 2 are added dropwise over a period of 1.5 hours. The reaction is exothermic to 55° C., and after all of the phosphorodithioic acid is added, the temperature of the reaction mixture is increased to 65° C. and maintained at this temperature for 2 hours. An additional 9 parts of the 50% aqueous sodium hydroxide solution are added, and the mixture is maintained for an additional 2 hours at 55°-65° C. The mixture is filtered through a filter aid, and the filtrate is the desired product as a 25% solution in the alcohol mixture. The product contains 12.92% sulfur (theory, 12.37).

EXAMPLE 9

A mixture of 146 parts (2.5 equivalents) of ammonium hydroxide and 40 parts of water is prepared. Beginning at room temperature, there is added 581.4 parts (2 equivalents) of the phosphorodithioic acid prepared in Example 1 over a period of 2.5 hours. The reaction is exothermic to 40° C., and after all of the phosphorodithioic acid is added, the reaction mixture is maintained at 50° C. for 2 hours. An additional 59.4 parts (0.2 equivalents) of the phosphorodithioic acid are added and the mixture is maintained at about 50° C. for 15 hours, cooled and filtered. The filtrate is the desired ammonium salt which is a clear liquid.

EXAMPLE 10

To 129 parts of ammonium hydroxide (2.3 equivalents) there is added 644.4 parts (2.0 equivalents) of the phosphorodithioic acid prepared in Example 2 over a period of 2 hours. The reaction is exothermic to 40° C. After stirring for 2 hours at this temperature, the mixture is cooled and 5 parts of ammonium hydroxide are added through a sub-surface inlet tube. The mixture is stirred at 40° C. for one hour whereupon 78 parts of the isobutylamyl alcohol mixture described in Example 1 are added. The mixture is filtered through a filter aid, and the filtrate is the desired ammonium salt containing 15.84% sulfur (theory, 14.95).

EXAMPLE 11

A mixture of 63 parts (1.55 equivalents) of zinc oxide, 144 parts of mineral oil and one part of acetic acid is prepared. A vacuum is applied and 533 parts (1.3 equivalents) of the phosphorodithioic acid prepared in Example 3 are added while heating the mixture to about 80° C. The temperature is maintained at 80°-85° C. for about 7 hours after the addition of the phosphorodithioic acid is complete. The residue is filtered, and the filtrate is the desired product containing 6.8% phosphorus.

EXAMPLE 12

A mixture of 541 parts (13.3 equivalents) of zinc oxide, 14.4 parts (0.24 equivalent) of acetic acid and 1228 parts of mineral oil is prepared, and a vacuum is applied while raising the temperature to about 70° C. The phosphorodithioic acid prepared in Example 4 (4512 parts, 12 equivalents) is added over a period of about 5 hours while maintaining the temperature at 68°-72° C. Water is removed as it forms in the reaction, and the temperature is maintained at 68°-72° C. for 2 hours after the addition of phosphorodithioic acid is complete. To insure complete removal of water, vacuum is adjusted to about 10 mm., and the temperature is raised to about 105° C. and maintained for 2 hours. The residue is filtered, and the filtrate is the desired product containing 6.26% phosphorus (theory, 6.09) and 6.86% zinc (theory, 6.38).

EXAMPLE 13

A mixture of 78.7 parts (1.1 equivalents) of cuprous oxide and 112 parts of mineral oil is prepared, and 384 parts (1 equivalent) of the phosphorodithioic acid prepared as in Example 4 are added over a period of 2 hours while raising the temperature gradually to about 55° C. Upon completion of the addition of the acid, the reaction mixture is maintained at about 50° C. for about 3 hours. A vacuum then is applied while raising the temperature to about 80° C. The residue is filtered, and the filtrate is the desired cuprous salt which is a clear liquid containing 12% sulfur (theory, 11.5) and 12.0% copper (theory, 11.4).

The amount of phosphorodithioic acid or salt thereof included in the slurry to be used in the flotation process is an amount which is effective in promoting the froth flotation process and providing improved separation of the desired mineral values. The amount of collector included in the slurry will depend upon a number of factors including the nature and type of ore, size of ore particles, etc. In general, from about 0.01 to about 1 pound of collector (B-2) is used per ton of ore.

The slurry prepared in step (B) also may optionally contain (B-4) a water-soluble inorganic base. The inclusion of a base is well known in the art for providing desirable pH values. By controlling and modifying the pH of the pulp slurry to levels of 8.0 and above, and more generally above about 11 prior to conditioning, and the pH of the slurry during the conditioning step to levels of about 6.0 to 7.0 through the addition of a base, the performance of the sulfide collectors is improved. The alkali and alkaline earth metal oxides and hydroxides are useful inorganic bases. Lime is a particularly useful base. In the process of the present invention, it has been discovered that the addition of a base to the ore or slurry containing the collectors of this invention results in a significant increase in the copper assay of the cleaner concentrates.

The slurry (B) used in the process of the present invention comprises the ground ore, at least one collector (B-2), water and optionally a water-soluble inorganic base. The slurries used in this invention will contain from about 20% to about 50% by weight of solids, and more generally from about 30% to 40% solids. Such slurries can be prepared by mixing all the above ingredients. Alternatively, the collector and inorganic base can be premixed with the ore either as the ore is being ground or after the ore has been ground to the desired particle size. Thus, in one embodiment, the ground pulp is prepared by grinding the ore in the presence of collector (B-2) and inorganic base (B-4) and this ground pulp is thereafter diluted with water to form the slurry. The amount of inorganic base included in the ground ore and/or the slurry prepared from the ore is an amount which is sufficient to provide the desired pH to the slurry in the subsequent conditioning step. This amount may be varied by one skilled in the art depending on particular preferences.

After the ore slurry has been prepared in accordance with any of the embodiments described above, the slurry is conditioned with sulfur dioxide under aeration at a pH of from about 5.5 to about 7.5. The conditioning medium is an aqueous solution formed by dissolving sulfur dioxide in water forming sulfurous acid ($H_2SO_3$). It has been found that when the ore slurry is conditioned with sulfurous acid and aerated, the $SO_2$ increases the flotation rate of copper minerals, and depresses the undesired gangue and undesirable minerals such as iron resulting in the recovery in subsequent treatment stages of a product that represents a surprising high recovery of copper values and a surprising low retention of iron. The amount of sulfur dioxide added to the slurry in the conditioning step can be varied over a wide range, and the precise amounts can be useful for a particular ore or flotation process can be readily determined by one skilled in the art. In general, the amount of sulfur dioxide utilized in the conditioning step is within the range of from about 1 to about 10 pounds of sulfur dioxide per ton of ground ore. It has now been discovered that an important factor in the conditioning step of the process of the invention is the pH of the slurry. The pH of the conditioned slurry should be maintained between about 5.5 and about 7.5, more preferably between about 6.0 to about 7.0. A pH of about 6.5 to about 7.0 is particularly preferred for the conditioned slurry.

Conditioning of the slurry is achieved by agitating the pulp contained in a conditioning tank such as by vigorous aeration and optionally, with a suitable agitator such as a motor-driven impeller, to provide good solid-liquid contact between the finely divided ore and the sulfurous acid. The pulp is conditioned sufficiently long to maximize depression of the undesirable minerals and gangue while maximizing activation of the desired minerals such as copper minerals. Thus, conditioning time will vary from ore to ore, but it has been found for the ores tested that conditioning times of between about 1 to 10 minutes and more generally from about 3 to 7 minutes provide adequate depression of the undesirable minerals and gangue.

One of the advantages of the conditioning step is that it allows recovery of a concentrate having very satisfactory copper content without requiring the introduction of lime, cyanide or other conditioning agents to the flotation circuit, although as mentioned above, the introduction of some lime improves the results obtained. Omitting these other conditioning agents, or reducing the amounts of lime or other conditioning agents offers relief for both the additional costs and the environmental and safety factors presented by these agents. However, as noted below, certain advantages are obtained when small amounts of such agents are utilized in the flotation steps.

Following the conditioning step, the slurry is subjected to a copper rougher flotation stage to recover most of the copper values in the froth (concentrate) while rejecting significant quantities of undesirable minerals and gangue in the underflow. The flotation stage of the flotation system, as schematically illustrated in the figure, comprises at least one roughing stage wherein a rougher concentrate is recovered, and one or more cleaning stages wherein the rougher concentrate is cleaned and upgraded. Tailing products from each of the stages can be routed to other stages for additional mineral recovery.

Flotation of copper is effected in the copper rougher stage at a slightly acidic pulp pH which is generally between about 6.0 and 7.0, the pH being governed by the quantity of sulfur dioxide used during the conditioning and aeration as well as the quantity of any inorganic base included in the slurry.

The copper rougher flotation stage will contain at least one frother, and the amount of frother added will be dependent upon the desired froth characteristics which can be selected with ease by one skilled in the art. A typical range of frother addition is from about 0.04 to about 0.1 pound of frother per ton of dry ore.

An essential ingredient of the slurry contained in the copper rougher stage is one or more of the collectors (B-2) described above. In one embodiment, the collector is included in the slurry in step (B), and additional collector may be added during the flotation steps including the rougher stage as well as the cleaner stage. In addition to the phosphorodithioic acids and salts, other types of collectors normally used in the flotation of sulfide ores can be used in combination with the phosphorodithioic acid or esters. The use of such auxiliary collectors in combination with the collectors (B-2) of this invention often results in improved and superior recovery of more concentrated copper values. These auxiliary collectors also may be added either to the rougher stage or the cleaning stage, or both.

A wide variety of frothing agents have been used successfully in the flotation of minerals from base metal sulfide ores, and any of the known frothing agents can be used in the process of the present invention. By way of illustration, such floating agents as straight or branched chain low molecular weight hydrocarbon alcohols such as C6–8 alkanols, 2-ethylhexanol and 4-methyl-2pentanol (also known as methylisobutylcarbinol, MIBC) may be employed as well as pine oils, cresylic acid, polyglycol or monoethers of polyglycols and alcohol ethoxylates.

As noted above, the froth flotation step can be improved by the inclusion of auxiliary collectors in addition to the phosphorodithioic acids or salts. Any of the known collectors can be utilized in combination with the collectors of this invention in the rougher stage and/or the cleaning stages of the invention. The most common collectors are hydrocarbon compounds which contain anionic or cationic polar groups. Examples include the fatty acids, the fatty acid soaps, xanthates, xanthate esters, thionocarbamates, dithiocarbamates, fatty sulfates, fatty sulfonates, mercaptans, thioureas and dialkyldithiophosphinates. The xanthates and thionocarbamates are particularly useful auxiliary collectors.

One group of xanthate collectors which has been utilized in froth flotation processes may be represented by the formula $$R—O—C(S)SM$$

wherein R is an alkyl group containing from 1 to 6 carbon atoms and M is a dissociating cation such as sodium or potassium. Examples of such xanthates include potassium amyl xanthate, sodium amyl xanthate, etc.

The thionocarbamates useful as auxiliary collectors include the dialkylthionocarbamates represented by the formula $$ROC(S)NHR'$$

wherein R and R' are alkyl groups. U.S. Pat. Nos. 2,691,635 and 3,907,854 describe processes for preparing dialkylthionocarbamates as represented by the above formula. These two patents are incorporated by reference herein for their disclosures of the methods of preparing suitable auxiliary collectors useful in this invention.

Hydrocarboxycarbonyl thionocarbamate compounds also have been reported as useful collectors for beneficiating sulfide ores. The hydrocarboxycarbonyl thionocarbamate compounds are represented by the formula $$R^1OC(O)N(H)C(S)OR^2$$

wheren $R^1$ and $R^2$ are each independently selected from saturated and unsaturated hydrocarbyl groups, alkyl polyether groups and aromatic groups. The preparation of these hydrocarboxycarbonyl thionocarbamic compounds and their use as collectors is described in U.S. Pat. No. 4,584,097, the disclosure of which is hereby incorporated by reference. Specific examples of auxiliary collectors which may be utilized in combination with the phosphorodithioic acid and acid salts of this invention include: sodium isopropyl xanthate, isopropyl ethyl thionocarbamate, N-ethyl O-isopropyl thionocarbamate, N-ethoxycarbonyl N'-isopropylthiourea, ethyl isopropyl thionocarbamate, etc In the rougher flotation step, the pulp is frothed for a period of time which maximizes copper recovery. The precise length of time is determined by the nature and size of the ore as well as other factors, and the time necessary for each individual ore can be readily determined by one skilled in the art. Typically, the froth flotation step is conducted for a period of from 2 to about 20 minutes and more generally from a period of about 5 to about 15 minutes. As the flotation step proceeds, small amounts of collectors may be added periodically to improve the flotation of the desired mineral values. The collector added periodically to the rougher concentrate may be additional amounts of the phosphorodithioic acid or salt included in the slurry and/or auxiliary collectors such as those mentioned above. In one preferred embodiment, the collectors present during the froth flotation comprise a mixture of one or more of the phosphorodithioic acid salts of the invention with one or more xanthate or thionocarbamate.

When the froth flotation has been conducted for the desired period of time, the copper rougher concentrate is collected, and the copper rougher tailing product is removed and may be subjected to further purification.

The recovered copper rougher concentrate is processed further to improve the copper grade and reduce the impurities within the concentrate. One or more cleaner flotation stages can be employed to improve the copper grade to a very satisfactory level without unduly reducing the overall copper recovery of the system. Generally, two cleaner flotation stages have been found to provide satisfactory results.

Prior to cleaning, however, the copper rougher concentrate is finely reground to reduce the particle size to a desirable level. In one embodiment, the particle size is reduced so that 60% is −400 mesh. The entire copper rougher concentrate can be comminuted to the required particle size or the rougher concentrate can be classified and only the oversized materials comminuted to the required particle size. The copper rougher concentrate can be classified by well-known means such as hydrocyclones. The particles larger than desired are reground to the proper size and are recombined with the remaining fraction.

The reground copper rougher concentrate then is cleaned in a conventional way by forming an aqueous slurry of the reground copper rougher concentrate in water. One or more frothers and one or more collectors are added to the slurry which is then subjected to a froth flotation. The collector utilized in this cleaner stage may be one or more of the phosphorodithioic acid or acid salts described above as (B-2) and/or any of the auxiliary collectors described above. In some applications, the addition of collector and a frother to the cleaning stage may not be necessary if sufficient quantities of the reagents have been carried along with the concentrate from the preceding copper rougher flotation. Small amounts of $SO_2$ also can be added to the copper cleaner stages. The duration of the first copper cleaner flotation is a period of from about 5 to about 20 minutes, and more generally for about 8 to about 15 minutes. At the end of the cleaning stage, the froth containing the copper cleaner concentrate is recovered and the underflow which contains the copper cleaner tailings is removed. In one preferred embodiment, the copper cleaner concentrate recovered in this manner is subjected to a second cleaning stage and which the requirements for collector and frother, as well as the length of time during which the flotation is carried out to obtain a highly satisfactory copper content and recovery can be readily determined by one skilled in the art.

When the process of the present invention is carried out on copper sulfide ores, and in particular, Cerro, Colorado mine copper sulfide ores, cleaned copper concentrates are found to contain high concentrations of copper with improved recoveries.

The following examples illustrate the process of the present invention. Unless otherwise indicated in the examples and elsewhere in the specification and claims, all parts and percentages are by weight, and temperatures are in degrees centigrade. Also in the following examples, the amounts of reagents added are expressed as "pounds per ton of dry ore" by which is meant pounds of reagent per ton of fresh dry ore which is ground, slurried and fed to the froth flotation system. The ore used in the following examples is Rio Tinto Cerro, Colorado mill ore (primarily chalcopyrite) assaying an average of about 0.54% copper, 12.5% iron and 0.27% zinc. The ore is crushed to pass 10 mesh, and ground to 50% passing 200 mesh.

In the following examples, the collector utilized is the sodium salt of the dithiophosphoric acid of Example 6 prepared from a mixture of isobutyl alcohol and primary amyl alcohols. The collector is added to the primary grind, and in some instances, additional amounts are added in the various process stages. In general, the ground pulp is diluted to 33% solids and conditioned with sulfur dioxide added as sulfurous acid for the times and at the pH indicated in the following tables. Typically, 6 to 7 pounds of sulfur dioxide per ton of ore are added in Examples II–IV. A rougher concentrate is floated for g minutes with additional collector added after 1.5, 3 and 6 minutes of flotation. Potassium amyl xanthate also is added as an auxiliary collector in the rougher stages of Examples II–IV to improve on the recovery of copper middlings. The rougher concentrate recovered is ground to 60 weight percent passing 400 mesh and cleaned twice.

In some of the examples, lime is added to the primary grind to provide pH control in the subsequent sulfur dioxide conditioning steps, and improved results are obtained. In all of the examples, the frothing agent is MIBC (4-methyl-2-pentanol), also known as methyl isobutyl carbinol.

The reagent balance for four experiments conducted in accordance with the process of the invention together with a summary of the times and pulp pH of the various steps are summarized in the following Tables I–IV. In general, Example II differs from Example I in that lime is added to the primary grind. Example III is similar to Example II except that the collector dosage is doubled. Example IV differs from Example III in that the regrind time is doubled.

TABLE I

| | Reagent Balance - Example I | | | | | | | | |
|---|---|---|---|---|---|---|---|---|---|
| | Reagents Added (lb/ton) | | | | | Time, Min | | | Pulp |
| Stage | $Ca(OH)_2$ | Collector | K-Amyl Xanthate | $SO_2$ | MIBC | Grind | Cond. | Froth | pH |
| Primary Grind | | 0.015 | | 2.00 | | 5 | | | 5.53 |
| Condition/Aeration | | | | 1.08 | | | 4 | | 4.96 |
| Rougher | | | | | | | | | |
| (1) | 2.32 | 0.015 | | | 0.010 | | 1 | 1.5 | |
| (2) | 0.64 | 0.015 | | | | | | 2 | 5.8 |
| (3) | 0.26 | 0.015 | | | | | | 2 | 6.1 |
| Regrind | | | | | | 4 | | | |
| First Cleaner | | | | | | | | | |
| (1) | 0.06 | 0.010 | | | 0.040 | | | 3 | 6.26 |
| (2) | | 0.010 | | | 0.020 | | | 2 | |
| Second Cleaner | | | | | 0.020 | | | 3 | 6.20 |
| Total | 3.28 | 0.080 | | 3.08 | 0.090 | | | | |

TABLE II

| | Reagent Balance - Example II | | | | | | | | |
|---|---|---|---|---|---|---|---|---|---|
| | Reagents Added (lb/ton) | | | | | Time, Min | | | Pulp |
| Stage | $Ca(OH)_2$ | Collector | K-Amyl Xanthate | $SO_2$ | MIBC | Grind | Cond. | Froth | pH |
| Primary Grind | 7.45 | 0.015 | | | | 5 | | | 11.6 |
| Condition/Aeration | | 0.015 | | 6.5 | | | 4 | | |
| Rougher | | | | | | | | | |
| (1) | | | | | | | | 1.5 | 6 |
| (2) | 0.10 | 0.015 | | | | | | 1.5 | |
| (3) | 0.40 | 0.015 | 0.010 | | 0.01 | | | 1.5 | |
| (4) | | 0.015 | 0.015 | | 0.01 | | | 3 | 6.7 |
| Regrind | | | | | | 4 | | | |
| First Cleaner | | | | | | | | | |
| (1) | | 0.010 | | 0.2 | 0.03 | | 2 | 6.7 | |
| (2) | | | | | | | | 3 | 6.8 |
| Second Cleaner | | | | | | | | 3 | 6.9 |
| Total | 7.95 | 0.085 | 0.025 | 6.7 | 0.05 | | | | |

TABLE III

| Stage | Reagent Balance - Example III: Reagents Added (lb/ton) Ca(OH)$_2$ | Collector | K-Amyl Xanthate | $SO_2$ | MIBC | Time, Min Grind | Cond. | Froth | Pulp pH |
|---|---|---|---|---|---|---|---|---|---|
| Primary Grind | 7.45 | 0.030 | | | | 5 | | | 11.20 |
| Condition/Aeration | | 0.030 | | 6.0 | | | 4 | | 6.8 |
| Rougher | | | | | | | | | |
| (1) | | | | | | | | 1.5 | |
| (2) | | 0.030 | | | | | | 1.5 | 6.7 |
| (3) | | 0.030 | 0.010 | | 0.01 | | | 3 | 6.7 |
| (4) | | 0.030 | 0.010 | | 0.01 | | | 3 | 6.7 |
| Regrind | | | | | | 4 | | | |
| First Cleaner | | | | | | | | | |
| (1) | | 0.020 | | 0.12 | 0.03 | | | 2 | 6.7 |
| (2) | | 0.020 | | | | | | 3 | 6.9 |
| Second Cleaner | | | | | 0.02 | | | 3 | 6.8 |
| Total | 7.45 | 0.190 | 0.020 | 6.12 | 0.07 | | | | |

TABLE IV

| Stage | Reagent Balance - Example IV: Reagents Added (lb/ton) Ca(OH)$_2$ | Collector | K-Amyl Xanthate | $SO_2$ | MICB | Time, Min Grind | Cond. | Froth | Pulp pH |
|---|---|---|---|---|---|---|---|---|---|
| Primary Grind | 7.45 | 0.030 | | | | 5 | | | 11.30 |
| Condition/Aeration | | 0.030 | | 6.0 | | | 4 | | 6.8 |
| Rougher | | | | | | | | | |
| (1) | | | | | | | | 1.5 | 6.8 |
| (2) | | 0.030 | | | | | | 1.5 | 6.8 |
| (3) | | 0.030 | 0.010 | | 0.01 | | | 3 | 6.7 |
| (4) | | 0.030 | 0.015 | | 0.01 | | | 3 | 6.7 |
| Regrind | | | | | | 8 | | | |
| First Cleaner | | | | | | | | | |
| (1) | | 0.030 | | 0.12 | 0.03 | | | 2 | 6.7 |
| (2) | | 0.015 | | | 0.02 | | | 3 | 6.9 |
| Second Cleaner | | | | | | | | 3 | 6.9 |
| Total | 7.45 | 0.195 | 0.025 | 6.12 | 0.07 | | | | |

In each of the above examples, the rougher concentrate and second cleaner concentrate were assayed for percent copper and percent copper distribution. A summary of the flotation test results is found in the following Table V.

TABLE V

Summary of Flotation Test Results

| Example | Calc. Head (% Cu) | Rougher Concentrate Wt. (%) | Assay % Cu | % Cu Distr. | Second Cleaner Concentrate Wt. (%) | Assay % Cu | % Cu Distr. |
|---|---|---|---|---|---|---|---|
| I | 0.507 | 10.69 | 4.02 | 84.7 | 2.53 | 11.8 | 58.9 |
| II | 0.545 | 7.98 | 5.49 | 84.9 | 1.49 | 23.0 | 62.9 |
| III | 0.526 | 9.72 | 4.82 | 89.0 | 1.62 | 20.7 | 63.7 |
| IV | 0.586 | 10.68 | 4.96 | 90.5 | 1.80 | 22.7 | 69.8 |

As can be seen from the results of the four examples, the sodium dithiophosphoric acid salt is an effective copper collector in the flotation system of the invention. Improved results are obtained when lime is added to the primary grind (Examples II–IV), and further improvement in the copper selectivity is obtained when the collector dosage is increased and the regrind time is increased.

EXAMPLE V

The general procedure of Example II is repeated except that the sodium salt of Example 6 is replaced by an equivalent amount of the zinc salt of Example 7.

EXAMPLE VI

The general procedure of Example II is repeated except that the sodium salt of Example 6 is replaced by an equivalent amount of the ammonium salt of Example 9.

EXAMPLE VII

The general procedure of Example II is repeated except that the sodium salt of Example 6 is replaced by an equivalent amount of the copper salt of Example 13.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A process of effecting the concentration of a metal value selected from the group consisting of zinc, copper and lead, from a sulfide ore containing said metal value and at least one of pyrite or pyrrhotite, with selective depression of said at least one of pyrite or pyrrhotite comprising the steps of:

(A) grinding the ore to an appropriate size range;

(B) preparing a slurry comprising (B-1) said ground ore;

(B-2) at least one metal value collector which is a water-dispersible or soluble dihydrocarbyl dithiophosphoric acid or salt having the formula

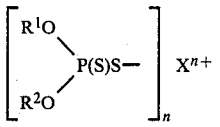

(I)

wherein $R^1$ is an alkyl group containing from 2 to about 12 carbon atoms and $R^2$ is an aryl group containing from 6 to about 18 carbon atoms, n is an integer equal to the valence of X and $X^{n+}$ is a dissociating cation; and (C) conditioning the slurry with $SO_2$ under aeration at a pH of about 6.0 to about 7.0 in an amount sufficient to depress said at least one of pyrite or pyrrhotite;

(D) subjecting the conditioned slurry to froth flotation to produce a froth containing a metal value rougher concentrate and a resultant slurry containing said at least one of pyrite or pyrrhotite which was depressed during the flotation;

(E) collecting said froth; and (F) recovering the metal value rougher concentrate containing the metal values.

2. The process of claim 1 wherein the metal value is copper.

3. The process of claim 1 wherein the metal value is lead or zinc.

4. The process of claim 1 wherein the ore is ground in step (A) in the presence of the collector (B-2).

5. The process of claim 1 wherein the slurry of (B) is prepared by diluting a ground pulp with water, said ground pulp being prepared by grinding the ore in the presence of the collector (B-2), and an inorganic base (B-4).

6. The process of claim 1 wherein X is hydrogen, an ammonium group, an alkali metal or a Group II metal.

7. The process of claim 6 wherein X is an alkali or alkaline earth metal.

8. The process of claim 6 wherein the dissociating cation is an alkali metal cation.

9. The process of claim 1 wherein the slurry (B) contains a water-soluble inorganic base (B-4).

10. The process of claim 9 wherein the inorganic base is an alkali or alkaline earth metal oxide, hydroxide, or mixtures thereof.

11. The process of claim 9 wherein the inorganic base is calcium hydroxide.

12. The process of claim 1 wherein the slurry is conditioned in step (C) at a pH of from about 6.5 to about 7.0.

13. The process of claim 1 wherein the froth flotation is effected in step (D) at a pH of from about 6.0 to about 7.0.

14. The process of claim 1 wherein additional mineral value collector (B-2) is added to the conditioned slurry during froth flotation step (D).

15. The process of claim 1 wherein the metal value rougher concentrate recovered in step (F) is (G) re-ground; and (H) subjected to at least one cleaning froth flotation process.

16. The process of claim 15 wherein additional collector (B-2) is introduced in the cleaning froth flotation process (H).

17. The process of claim 1 wherein at least one xanthate or dithionocarbamate metal value collector is added to the conditioned slurry during the froth flotation step (D).

18. A process for the benefication of an ore containing copper sulfide minerals and at least one of pyrite or pyrrhotite with selective depression of said at least one of pyrite or pyrrhotite comprising the steps of:

(A) grinding the ore to an appropriate size range;

(B) preparing a slurry comprising (B-1) said ground ore;

(B-2) at least one copper collector which is a water-dispersible or soluble dihydrocarbyldithiophosphoric acid or salt having the formula

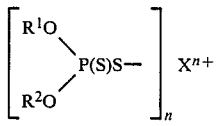

(I)

wherein $R^1$ is an alkyl group containing from 2 to about 12 carbon atoms and $R^2$ is an aryl group containing from 6 to about 18 carbon atoms, n is an integer equal to the valence of X and $X^{n+}$ is a dissociating cation; and (C) conditioning the slurry with $SO_2$ under aeration at a pH of about 6.0 to about 7.0 in an amount sufficient to depress said at least one of pyrite or pyrrhotite;

(D) subjecting the conditioned slurry to froth flotation to produce a froth containing copper rougher concentrate and a resultant slurry containing said at least one of pyrite or pyrrhotite which was depressed during the flotation;

(E) collecting said froth; and (F) recovering the copper rougher concentrate.

(G) regrinding the recovered copper rougher concentrate;

(H) subjecting the reground concentrate to at least one cleaning froth flotation process to form a copper cleaner concentrate; and (I) recovering a copper cleaner concentrate.

19. The process of claim 18 wherein the slurry of (B) also contains a water-soluble inorganic base (B-4).

20. The process of claim 19 wherein the ore 1s ground in step (A) in the presence of said collector (B-2) and inorganic base (B-4).

21. The process of claim 19 wherein the slurry of (B) is prepared by diluting a ground pulp with water, said ground pulp being prepared by grinding the ore in the presence of said collector (B-2) and said inorganic base (B-4).

22. The process of claim 18 wherein X is an ammonium group, an alkali metal or a Group II metal.

23. The process of claim 22 wherein X is an alkali metal.

24. The process of claim 23 wherein X is sodium.

25. The process of claim 18 wherein from about 0.01 to about 1.0 pound of said collector (B-2) is used per ton of ore.

26. The process of claim 19 wherein the inorganic base is an alkali or alkaline earth metal oxide, hydroxide or mixtures thereof.

27. The process of claim 26 wherein the inorganic base is calcium hydroxide.

28. The process of claim 18 wherein the slurry is conditioned in step (C) at a pH of about 6.5 to about 7.0.

29. The process of claim 18 wherein the froth flotation is effected in step (D) at a pH of from about 6.0 to about 7.0.

30. The process of claim 18 wherein additional copper collector (B-2) is added to the conditioned slurry during froth flotation in step (D).

31. The process of claim 28 wherein additional copper collector (B-2) is added in the cleaning froth flotation process (H).

32. The process of claim 18 wherein at least one xanthate or dithionocarbamate copper collector is added to the conditioned slurry during the froth flotation.

33. The process of claim 18 wherein the slurry is conditioned in step (C) by addition of from about 1 to about 10 pounds of $SO_2$ per ton of ground ore.

34. The process of claim 18 wherein said collector (B-2) comprises a mixture of dihydrocarbyldithiophosphoric acids or salts of Formula I and also containing minor amounts of acids or salts wherein $R^1$ and $R^2$ are the same alkyl group.

* * * * *